US005581337A

United States Patent [19]

Suzuki

[11] Patent Number: 5,581,337

[45] Date of Patent: Dec. 3, 1996

[54] DEVELOPING APPARATUS AND IMAGE FORMING APPARATUS EMPLOYING MIXING BALLS IN THE CARTRIDGE SUPPLY CONTAINER

[75] Inventor: Eiji Suzuki, Kawasaki, Japan

[73] Assignee: Fujitsu Limited, Kawasaki, Japan

[21] Appl. No.: 222,391

[22] Filed: Apr. 4, 1994

[30] Foreign Application Priority Data

May 31, 1993 [JP] Japan ..... 5-129660

[51] Int. Cl.[6] ..... G03G 15/06

[52] U.S. Cl. ..... 355/260; 118/653; 355/246

[58] Field of Search ..... 355/245, 246, 355/251, 253, 259, 260; 118/653, 656–658

[56] References Cited

U.S. PATENT DOCUMENTS

| | | | |
|---|---|---|---|
| 4,089,601 | 5/1978 | Navone | 35/245 |
| 4,565,435 | 1/1986 | Hart | 55/220 |
| 4,611,494 | 9/1986 | Uchiyama | 73/626 |
| 4,625,895 | 12/1986 | Tsukano | 118/653 X |
| 4,629,309 | 12/1986 | Tsukano et al. | 355/245 |
| 4,768,055 | 8/1988 | Takamatsu et al. | 355/298 |
| 4,894,688 | 1/1990 | Taniguchi et al. | 355/298 |
| 5,084,734 | 1/1992 | Yoshino et al. | 355/260 |
| 5,092,337 | 3/1992 | Uchiumi et al. | 128/661.01 |
| 5,101,237 | 3/1992 | Molloy | 355/245 |
| 5,109,254 | 4/1992 | Oka et al. | 355/200 |
| 5,121,168 | 6/1992 | Aoki et al. | 355/298 |
| 5,186,175 | 2/1993 | Hirama et al. | 128/661.01 |
| 5,243,390 | 8/1993 | Takemoto et al. | 35/245 |
| 5,260,750 | 11/1993 | Ishida et al. | 355/260 |
| 5,383,007 | 1/1995 | Kinoshita et al. | 355/246 |
| 5,384,629 | 1/1995 | Watanabe et al. . | |
| 5,508,794 | 4/1996 | Ikesue et al. | 355/260 |
| 5,541,714 | 7/1996 | Watanabe et al. . | |

FOREIGN PATENT DOCUMENTS

| | | |
|---|---|---|
| 0435596 | 7/1991 | European Pat. Off. . |
| 4038677 | 6/1991 | Germany . |
| 59-30576 | 2/1984 | Japan . |
| 61-57965 | 3/1986 | Japan . |
| 3-101759 | 4/1991 | Japan . |
| 4-118675 | 4/1992 | Japan . |
| 4-173131 | 6/1992 | Japan . |

OTHER PUBLICATIONS

Yamada, "Toner Supervising Device for Electrophotographic Device," *Patent Abstracts of Japan*, vol. 10, No. 198 (P–476), Jul. 11, 1986 & JP–A–61 041159 (RICHOH), Feb. 27, 1986.

*Primary Examiner*—Shuk Yin Lee
*Attorney, Agent, or Firm*—Staas & Halsey

[57] ABSTRACT

In a developing apparatus and image forming apparatus, a container accommodates a two-component developer, a stirring and conveying screw stirring and conveying the two-component developer in the container and the development carrier conveying the two-component developer, stirred by the screw, to a latent image carrier which carries an electrostatic latent image. Balls, each having a diameter larger than a gap between an outer diameter portion of the screw and a bottom support surface of the container, are received along with the developer in the container and are stirred with the developer by the screw to facilitate conveyance and discharge of used developer from the container.

14 Claims, 12 Drawing Sheets

Fig.12

| BALL | NUMBER OF BALL | RESIDUAL AMOUNT OF DEVELOPER DISCHARGED |
|---|---|---|
| NO | NO | 70g |
| Φ4 BALL | 10 | 50g |
| Φ8 BALL | 10 | 40g |
| Φ4 BALL<br>Φ8 BALL | 5<br>5 | 30g |

DEVELOPING APPARATUS AND IMAGE FORMING APPARATUS EMPLOYING MIXING BALLS IN THE CARTRIDGE SUPPLY CONTAINER

BACKGROUND OF THE INVENTION

1. Field of the Invention

The present invention relates to a developing apparatus by which a latent image on a latent image carrier is made visible using a two-component developer and also to an image forming apparatus, of an electrophotographic system or an electrostatic recording system, which performs image formation on a latent image carrier, such as a photoreceptor, and a dielectric substance using the above developing apparatus.

Recently, the dimensions of printers, which are image forming apparatus, have been reduced. In accordance with the reduction in the dimensions, a compact screw type developing apparatus has been used because of the highly efficient stirring and conveyance properties thereof.

2. Description of the Related Art

A developer used in a known screw type developing apparatus is composed of carrier particles, the particle size of which is 60 μm, and toner particles, the particle size of which is 10 μm, wherein the mixing ratio of toner to carrier is 4 to 6 weight %. A known developing roller includes a magnetic roller having a plurality of fixed magnetic poles; and a cylindrical rotational sleeve made of non-magnetic material, wherein the magnet roller is provided in the cylindrical rotational sleeve. Around the developing roller, there is provided a metallic doctor blade which scrapes away surplus developer so that a toner layer of a predetermined thickness can be formed on the developing roller, and also a metallic recovery blade which scrapes and recovers the developer from the developing roller after development.

Screws and paddles are implementations of stirring and conveying means for triboelectrically charging toner and carrier and supplying them to the developing roller. The screws are spiral screws made of resin, disposed in parallel with the shaft of the developing roller; and a partition plate is provided between the two screws.

There are provided two types of spiral screws. One is a spiral screw provided with a spiral blade and the other is a spiral screw provided with a spiral blade.

The spiral type screws are provided in such a manner that two screws are disposed in parallel. In order to stir and convey the developer between the two, they are driven reversely (i.e., oppositely), relatively to each other.

When one of the spiral type screws is rotated in one direction, the developer is taken from a supply adjacent a lower portion of the spiral type screw and discharged from an upper portion. In this way, the developer is conveyed from the spiral type screw to the developing roller.

Paddles are made of the same material as that of the screws. The paddles are composed of several thin plate-shaped blades provided at both ends of the shafts of the screws. These paddles have the function of extruding and conveying the developer so that the developer cannot remain at the ends of the two screws.

The screws are rotational bodies rotated when torque is transmitted to the end portions of the shafts from a drive system. Accordingly, there is provided a gap between the outer diameters (blades) of the screws and the bottom portion of the developer accommodating container. Therefore, sometimes the developer remains in that bottom portion of the container without being conveyed.

Accordingly, in the case of a small developing apparatus in which only a small amount of developer is accommodated, when even only a minute amount of developer remains in the gap, all the developer cannot be used, which causes a problem.

In the conventional screw developing apparatus, the developer stirring and conveying efficiency of the screws is lowered due to the gap, so that the quality of the developer deteriorates. That is, when the developer remains in the gap, an absolute amount of carrier used for toner conveyance is reduced, so that loads are given to carrier particles due to abrasion and shock. Accordingly, toner filming occurs very early on the surfaces on carrier particles, and the surface resin layers of the carrier particles are early worn away, which deteriorates the durability of carrier.

In the case of the conventional screw type developing apparatus, when the used developer of which the life has expired is discharged from the discharging port provided in the developer accommodating container, an amount of the used developer of about 70 g remains in the developer accommodating container in which the developer of about 700 g can be accommodated.

Accordingly, even when the used developer is discharged and new developer is supplied, the carrier is used, the toner conveyance properties of which are deteriorated due to the surface abrasion of remaining developer and toner filming. Consequently, in the image forming apparatus provided with the conventional screw developing apparatus, even after the developer has been replaced, the problems of uneven density and whitening are caused in the formed image.

SUMMARY OF THE INVENTION

It is an object of the present invention to provide a developing apparatus capable of developing excellent images, and to provide an image forming apparatus capable of conducting an excellent image forming operation.

Another object of the present invention is to provide a developing apparatus in which an amount of developer remaining between the outside of the conveyance means and the developer accommodating container can be reduced. Still another object of the present invention is to provide a developing apparatus by which a limited amount of developer can be effectively utilized.

Still another object of the present invention is to provide a developing apparatus in which the two-component developer stirring and conveying properties of the stirring and conveying means can be improved. Still another object of the present invention is to provide a developing apparatus in which the quality of developer can be stabilized so that the developer can be utilized over a long period of time.

Still another object of the present invention is to provide a developing apparatus capable of improving the discharging efficiency of used developer, the life of which has expired.

According to the present invention, there is provided a developing apparatus comprising: a developer accommodating container for accommodating therein developer, a stirring and conveying means for stirring and conveying the developer in said developer accommodating container and balls, each having a diameter larger than a gap formed between an outer diameter portion of said stirring and conveying means and a bottom portion of said developer accommodating container. The balls are stirred and conveyed by the conveyance force of said stirring and conveying means together with the developer in said developer accommodating container.

According to another aspect of the present invention, there is provided an image forming apparatus comprising a latent image carrier on which a latent image is formed in accordance with image information, a developer accommodating container for accommodating developer, a stirring and conveying means for stirring and conveying the developer in said developer accommodating container, a developer carrier for carrying the developer stirred by said stirring and conveying means to said latent image carrier, and balls each having a diameter larger than a gap formed between an outer diameter portion of said stirring and conveying means and a bottom portion of said developer accommodating container. The balls are stirred and conveyed by the conveyance force of said stirring and conveying means together with the developer in said developer accommodating container.

BRIEF DESCRIPTION OF THE DRAWINGS

FIGS. 1(A) and 1(B) are views showing the principle of the present invention; wherein FIG. 1(A) is a sectional view of a primary portion and FIG. 1(B) is a plan view;

FIGS. 5(A) and 5(B) are schematic illustrations showing the construction of the developing unit of the image forming apparatus shown in FIG. 2, wherein FIG. 5(A) is a plan view and FIG. 5(B) is a longitudinal sectional view in a plane along line 5B—5B in FIG. 5A;

FIGS. 6(A) and 6(B) are views for explaining the effect of the present invention, wherein FIG. 6(A) is a perspective view and FIG. 6(B) is a side elevational view;

FIGS. 10(A) and 10(B) are schematic illustrations of the cartridge, wherein FIG. 10(A) shows recovery of developer and FIG. 10(B) shows supply of developer;

FIG. 12 is a view for explaining the discharging efficiency of developer.

DETAILED DESCRIPTION OF THE INVENTION

Figure 1A:
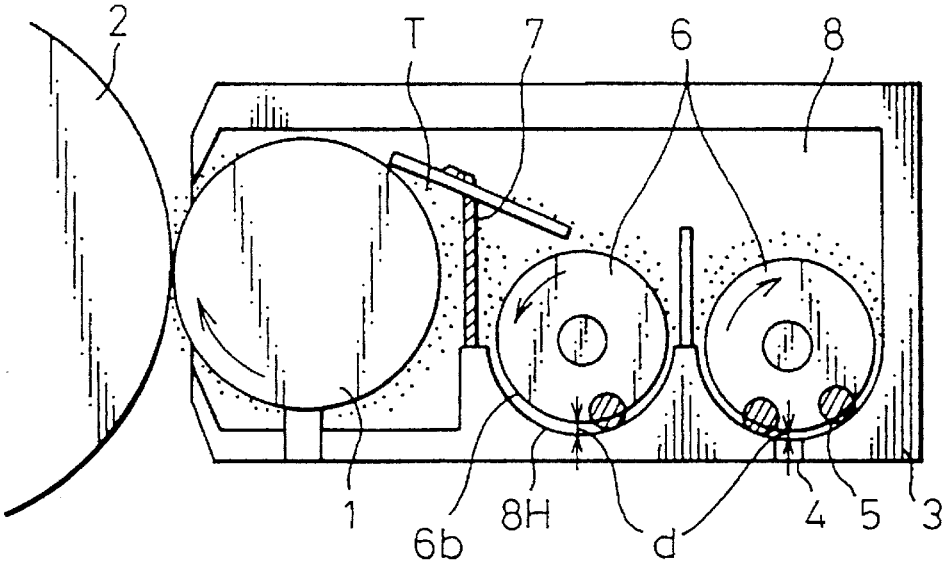
Figure 1B:
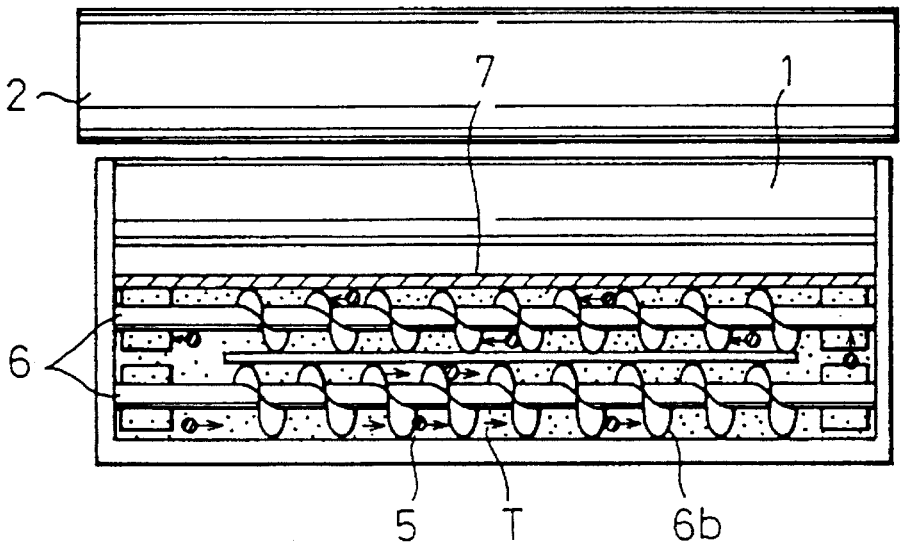

FIGS. 1(A) and 1(B) show the principle of the present invention, wherein FIG. 1(A) is a sectional view showing a primary portion, and FIG. 1(B) is a plan view.

A developing apparatus comprises a developer accommodating container 8 for accommodating therein a two-component developer T; a stirring and conveying means (device) 6 for stirring and conveying the two-component developer T in the developer accommodating container 8; and a developer carrier 1 for carrying the two-component developer T stirred by the stirring and conveying means 6 to a latent image carrier 2 for carrying an electrostatic latent image.

According to the present invention, said developing apparatus further comprises a ball 5 having a diameter larger than a gap d formed between an outer diameter portion 6*b* of the stirring and conveying means 6 and a bottom portion 8H of the developer accommodating container 8, wherein the ball 5 is stirred and conveyed by the conveyance force of the stirring and conveying means 6 together with the two-component developer T in the developer accommodating container 8.

The developer T is conveyed by the stirring and conveying means 6 together with the ball 5 diameter larger than the gap d, formed between the outer diameter portion 6*b* of the stirring and conveying means 6 and the bottom portion 8H of the developer accommodating container 8. Due to the foregoing, the frictional stirring action and the conveyance properties of the stirring and conveying means 6 are improved, so that the quality of developer T can be stabilized, and image formation can be conducted without the occurrence of uneven density and whitening. The developer T can be prevented from remaining in the gap d, formed between the outer diameter portion 6*b* of the stirring and conveying means 6 and the bottom portion 8H of the developer accommodating container 8. Consequently, even in the case of a small developing apparatus in which a limited small amount of developer T is accommodated, it is possible to effectively utilize the developer T.

Further, it is possible to prevent the developer T from remaining in the gap d, and thus the developer T can be effectively utilized. Therefore, it is possible to prevent the occurrence of abrasion of carrier particle surfaces, and it is also possible to prevent the occurrence of toner filming. Accordingly, the life of the two-component developer, composed of carrier and toner, can be extended.

According to another aspect of the present invention, said developing apparatus further comprises a ball 5 having a diameter larger than a gap d formed between an outer diameter portion 6*b* of the stirring and conveying means 6 and a bottom portion 8H of the developer accommodating container 8, wherein the ball 5 is stirred and conveyed by the conveyance force of the stirring and conveying means 6 together with the two-component developer T in the developer accommodating container 8; and a regulating means (i.e., device). 7 for regulating the movement of the ball 5 relatively to the developer carrier 1, the regulating means 7 being provided between the stirring and conveying means 6 and the developer carrier 1.

Since the regulating means 7 is provided between the development carrier 1 and the stirring and conveying means 6, it is possible to prevent the occurrence of the following problems. One problem is that, when the apparatus is transported, the ball 5 is moved onto the side of the development carrier 1 thereby damaging the surface of the development carrier 1 and whereby the developer conveyance properties of the development carrier 1 are deteriorated. Another problem is that the ball 5 jumps out of the developer accommodating container 8 and the developer scatters as dust, the image forming operation being affected by the dust.

According to still another aspect of the present invention, said developing apparatus further comprises a ball 5 having a diameter larger than a gap d formed between an outer diameter portion 6b of the stirring and conveying means 6 and a bottom portion 8H of the developer accommodating container 8, wherein the ball 5 is stirred and conveyed by the conveyance force of the stirring and conveying means 6 together with the two-component developer T in the developer accommodating container 8 and, further, a developer discharging port 4 for discharging the two-component developer T in the developer accommodating container 8, the developer discharging port 4 being provided in the developer accommodating container 8.

The toner discharging efficiency thereby is improved when the developer T is discharged from the developer discharging port 4. Therefore, in the process of image formation, it is possible to prevent the occurrence of uneven density and whitening caused by residual, used developer which remains in the process of developer replacement.

In one embodiment, the developing apparatus comprises a regulating member disposed at the developer discharge port 4 for preventing the discharge of the ball 5.

Accordingly, it is not necessary to replace the ball 5 like the developer T and, instead the ball 5 can be handled as a component of the developing and image forming apparatus. Consequently, it is possible to use the ball 5 until the life of the developing and image forming apparatus expires.

If the ball 5 is made of non-magnetic material, the developer T made of magnetic material can be prevented from being deposited on the surface of the ball 5. Therefore, it is possible to prevent the conveyance properties of the development carrier 1 from deteriorating while the ball 5 adheres to the development carrier 1 having a magnet roller.

In another embodiment, the surface of the ball 5 is composed of the same material as that of the developer T.

The surface of the ball 5 is processed by the material composing the developer T. Therefore, the triboelectric charging properties of the developer T be not affected by the ball 5 and deterioration of the quality of the developer T is prevented, and further the surface strength can be improved. Consequently, it is possible to use the developer T over a long period of time.

Figure 2:
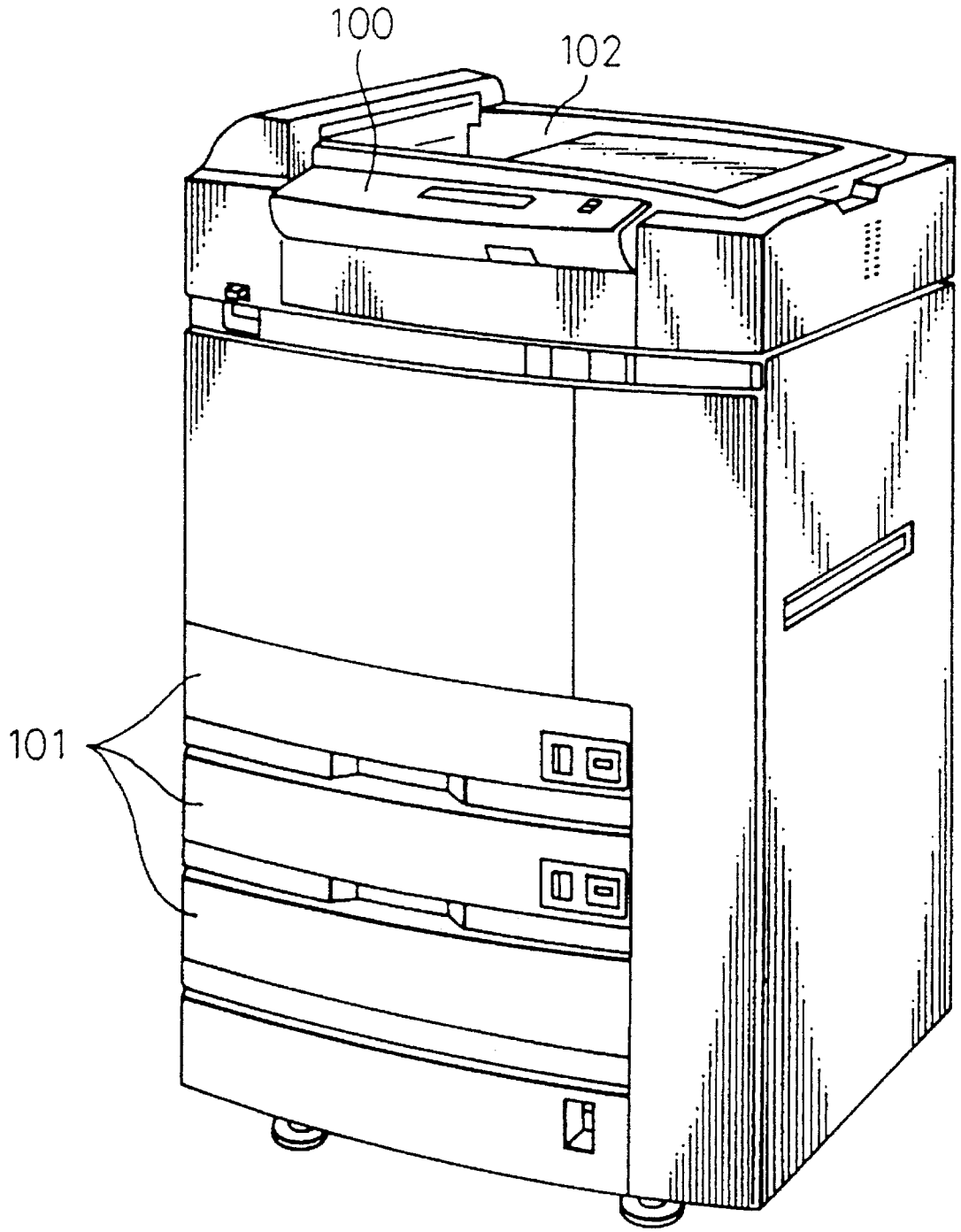
FIG. 2 is an outer appearance view of the image forming apparatus of an embodiment of the present invention.

FIG. 2 is a view showing the outer appearance of the image forming apparatus of an embodiment of the present invention. A laser printer is taken for an example here. Numeral 100 is an operation panel for conducting various operations, directing the supply of recording sheets, and displaying the occurrence of sheet jam and so on. Numeral 101 is a drawer type sheet cassette composed of upper, middle and lower steps, or drawers. Recording sheets of, size are accommodated in each step (drawer). Numeral 102 is a stacker for accommodating printed (original) recording sheets to be copied.

Figure 3:
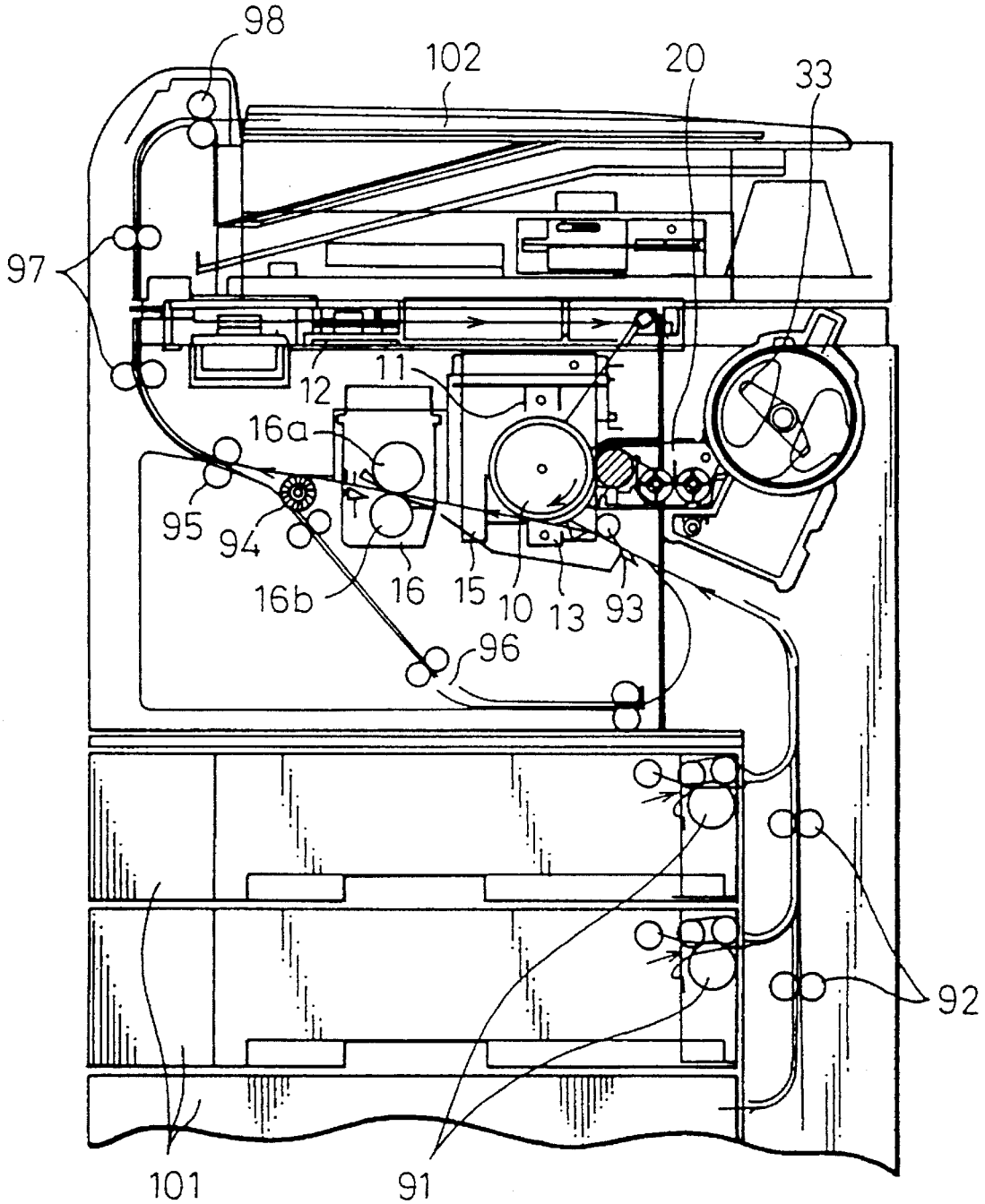
FIG. 3 is a schematic illustration showing the inner construction of the image forming apparatus shown in FIG. 2.
Figure 4:
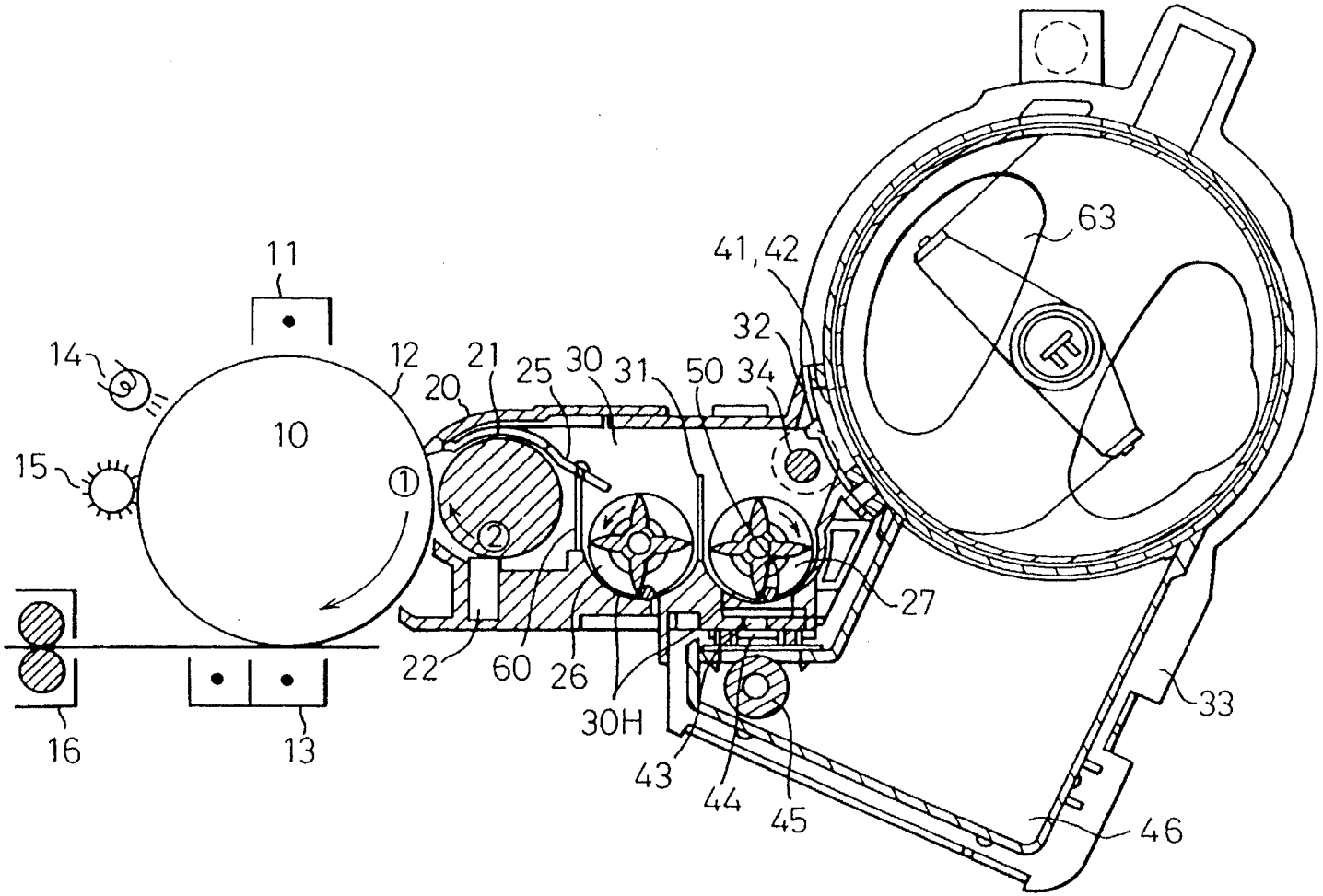
FIG. 4 is a schematic illustration showing the image forming section of the image forming apparatus shown in FIG. 2.

FIG. 3 is a schematic illustration showing the inner arrangement of the image forming apparatus shown in FIG. 2. In FIG. 3, the image forming section and sheet conveyance path are shown. A recording sheet is drawn from a selected sheet cassette 101 by a corresponding pickup roller 91, and conveyed by a conveyance roller 92 to a waiting roller 93 positioned just before the image forming section. The image forming section includes a photoreceptor drum 10, charging unit 11, exposing unit 12, developing unit 20, transfer unit 13, discharging lamp 14, cleaner unit 15, and fixing unit 16, as also shown in FIG. 4. The photoreceptor drum 10 is made of an organic photoreceptor or an amorphous silicon photoreceptor material. The outer diameter of the photoreceptor drum 10 is 80 mm, the entire length is 356 mm, and the rotational speed is 130 mm/sec. Also, the exposing unit 12 has an optical beam scanning system including a light source composed of a semiconductor laser and an fθ lens and a polygonal mirror by which a beam of light, sent from the semiconductor laser, scans the surface of the photoreceptor drum 10 at a constant speed.

In the case of recording an image, the photoreceptor drum 10 is rotated in the direction of arrow ①, and the surface of the photoreceptor drum 10 is uniformly, negatively charged by a corona discharge conducted by the charging unit 11 (for example, the photoreceptor drum 10 is charged to −600 V). Next, the character code given by a host computer and others is converted into a dot pattern. Then, the semiconductor laser is driven in accordance with a video signal corresponding to this dot pattern. Due to the foregoing, the surface of the photoreceptor drum 10 is irradiated with a beam of light.

When the photoreceptor drum 10 is irradiated with a beam of light corresponding to the dot pattern, an electric charge in the exposed portion of the photoreceptor drum 10 is reduced, so that an electrostatic latent image is formed on the photoreceptor drum 10. When this latent image region passes through the developing unit 20, negatively charged toner particles are electrostatically attracted onto the photoreceptor drum 10, and a toner image is formed.

On the other hand, a recording sheet is supplied one by one by the pickup roller 91, conveyance roller 92 and waiting roller 93 to a position where the recording sheet can be contacted with the toner image formed on the photoreceptor drum 10. The transfer unit 13 is disposed under the photoreceptor drum 10, wherein the recording sheet is interposed between the transfer unit 13 and the photoreceptor 10. Therefore, a positive electric charge is given to the reverse side of the recording sheet. Accordingly, the toner image formed on the photoreceptor drum 10 is attracted by the positive electric charge given to the reverse side of the recording sheet and transferred onto the recording sheet.

The recording sheet, onto which the toner image has been transferred, is conveyed and interposed between a heat roller 16a of the fixing unit 16 and a rubber roller 16b which is pushed against and rotated with the heat roller 16a. In the process of conveyance, the toner image on the recording sheet is fixed by the action of heat and pressure. After that, the recording sheet passes through a switchback roller 95, and is conveyed by discharging guide rollers 97 and a discharging roller 98. Then, the recording sheet is discharged onto the stacker 102.

After the transfer operation, residual toner on the surface of the photoreceptor drum 10 is removed and cleaned by the cleaner unit 15. Further, the surface of the photoreceptor drum 10 is entirely discharged by the discharging lamp 14, and returned to its initial condition. Then the surface of the photoreceptor drum 10 is moved toward a pre-charging section in which the charging unit 11 is disposed so that the aforementioned operational cycle can be repeated. In this connection, the above explanation is made under the condition of negative charging; however, positive charging can be carried out in the same process.

In the case of duplex printing, a trailing end of the recording sheet which has passed through the fixing unit 16 is directed toward a reverse side printing conveyance path 96 by the action of an impeller 94. Then the recording sheet is conveyed to the reverse side printing path 96 by the switchback roller 95. This recording sheet is conveyed to the waiting roller 93 by a conveyance roller provided in the reverse side printing conveyance path 96.

After that, the same printing operation is conducted on the recording sheet so that an image is printed on the reverse side. After that, the recording sheet passes through the switchback roller 95, and is conveyed by the discharging guide roller 97 and the discharging roller 98. Then, the recording sheet is discharged onto the stacker 102.

Figure 5A:
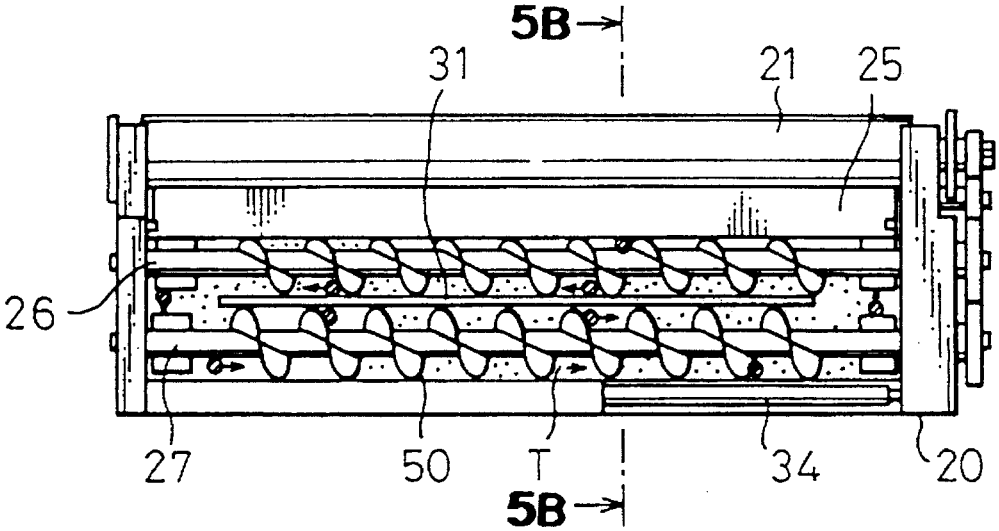
Figure 5B:
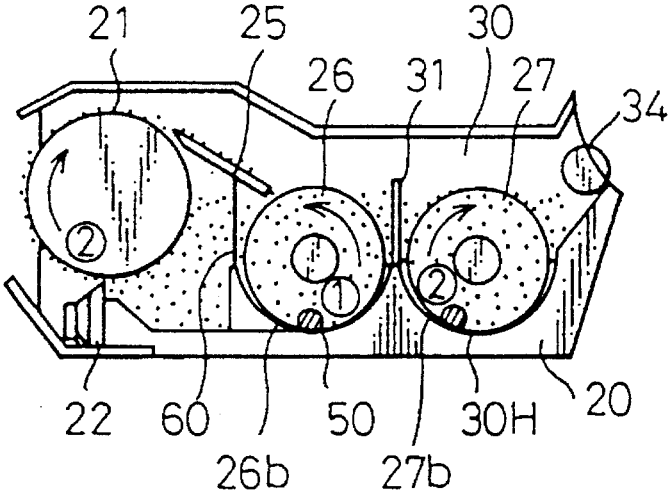

FIG. 4 is a schematic illustration showing an outline of the construction of the image forming apparatus shown in FIG. 2. FIGS. 5(A) and 5(B) are schematic illustrations of the construction of the developing unit. FIG. 5(A) is a plan view, and FIG. 5(B) is a sectional view taken along line 5B—5B in FIG. 5(A). Numeral 30 is a developer accommodating container for accommodating two-component developer composed of toner and carrier. Numeral 33 is a cartridge for accommodating developer which is to be supplied to the developing unit 20. In this case, the cartridge 33 is detachably connected to the developing unit 20.

Receiving ports 32 are provided on the side of the developing unit 20 and opposed to a new developer charging port 41 and a toner charging port 42 which are separately provided in the cartridge 33. New developer and toner are supplied from these ports. The toner is supplied from the toner charging port 42 and put into the developer accommodating container 33 by a supply roller 34 provided only at a position opposed to the toner charging port 42.

A developing roller 21 for conveying two-component developer is rotated in a reverse direction, shown by arrow ②, with respect to the direction ① of the photoreceptor drum 10. A developing bias of −400 V is impressed upon the developing roller 21.

This developing roller 21 includes a fixed magnet roller having a plurality of magnetic poles, and a rotational cylindrical sleeve made of non-magnetic material. In this case, the magnet roller is provided inside the rotational cylindrical sleeve. When the rotational sleeve is rotated, a magnetic brush composed of two-component developer containing toner and carrier is formed on the rotational sleeve. In this way, the two-component developer is conveyed onto the photoreceptor drum 10.

When an electric potential difference between the potential on the photoreceptor drum 10 and the development bias impressed upon the developing roller 21 is utilized, toner particles are electrostatically moved onto the photoreceptor drum 10 so that a visual image can be formed. A doctor blade 22 made of metal makes the thickness of a layer of developer T constant, that is, the ears of developer T formed on the developing roller 21 by the action of magnetic force, in other words, the layer thickness of the ears of the magnetic brush is made constant by the doctor blade 22.

A thin plate-shaped recovery blade 25 made of metal is contacted with the developing roller 21, and scrapes the developer T from the developing roller 21 after the completion of development. In this connection, examples of usable materials of the recovery blade 25 are stainless steel and phosphor bronze. A resin film and a rubber plate made of urethane and silicon rubber may be provided on, and define a contact surface of, the fore end of the recovery blade 25, the recovery blade 25 thus coming into contact with the developing roller 21 through the contact surface.

In this connection, the doctor blade 22 and the recovery blade 25 are made of metal, so that they are electrically conductive. Therefore, the same bias (−400 V) as the developing bias is impressed upon the doctor blade 22 and the recovery blade 25 so that the development bias voltage, impressed upon the developing roller 21, cannot leak.

Two spiral screws 26, 27 for stirring the developer T, composed of toner and carrier, are provided with right-handed spiral impellers and disposed in parallel with the developing roller 43. The rotational directions of the screws 26, 27 are shown by the arrows ① and ② in FIG. 5(B). In the case where spiral screws provided with left-handed impellers are used, the rotational direction of each spiral screw is opposite to the rotational direction shown in FIG. 5. In this way, the same effect can be provided.

In the developer accommodating container 30, a partition plate 31 is disposed between the screws 26 and 27. The bottom portion 30H of the developer accommodating container 30 is designed in such a manner that the configuration of the bottom portion 30H is curved in accordance with the outer configurations of the screws 26, 27, so that the two-component developer T cannot remain in the bottom portion 30H.

Paddles 28, 29 are provided on both sides of the shafts 26*a*, 27*a* of the screws 26, 27. By the action of the paddles, it is possible to push out the developer T so that the developer T can be circulated and conveyed between the screws 26 and 27.

The used developer T, i.e., the life of which has expired, is discharged through a discharging port 43 from the developer accommodating container 30. The discharging port 43 is provided with a discharging shutter 44 by which the discharging port 43 is opened and closed. An opening of the used developer accommodating container 46 provided in a portion of the cartridge 33 is disposed at a position opposed to the discharging port 43.

The used developer T is accommodated in a used developer accommodating section through the discharging port 43 and the opening portion of the used developer accommodating container 46 of the cartridge 33. In this connection, a conveyance screw 45 is provided for conveying the used developer T into the used developer accommodating section.

When the cartridge 33 is to be replaced, the used developer T in the developer accommodating container 30 is discharged from the discharging port 43 into the used developer accommodating container 46. In this way, the used developer T can be discharged without replacing the developing unit 20 itself. Construction of the cartridge 33, and supply and recovery of the developer will be described later.

In the construction described above, the outer diameter of the developing roller 21 is ϕ30 mm, the developing width is 297 mm, and the rotational speed is 254 rpm. The overall length of the screws 26, 27 is approximately 329 mm, the shaft diameter is 8 mm, the outer diameter is 25 mm, and the impeller thickness is 1 mm. The screws 26, 27 are made of resin. The impeller interval (pitch) of the screws 26, 27 is 25 mm, and their rotational speed is 254 rpm. The gap d formed between the outer diameter portions (impellers) 26*b*, 27*b* of the screws 26, 27 and the bottom plate 30H of the developer accommodating container 30 is approximately 0.5 mm.

In the case where the screws 26, 27 are made of conductive material, it is necessary to impress the same developing bias upon each screw to permit the electrical potential in the developing unit to be uniform so that the developing bias voltage cannot leak from the developing roller 21.

The two-component developer T is composed of toner, the average particle size of which is 10 μm, and carrier coated with resin, the average particle size of which is 60 μm. Total weight of the two-component developer accommodated in the developer accommodating container 30 is approximately 700 g. In this two-component developer T, the mixing ratio of carrier to toner is 4 to 6 weight %.

Further, several to several tens of balls 50, made of stainless steel, are put into the developer accommodating container 30 together with the two-component developer T. These balls 50 are made of material of high density so that they can go down (i.e., penetrate and sink) by their own weight into the two-component developer T, located close to the bottom portion 30H of the developer accommodating container 30. Also, the balls 50 are made of a hard material, or made of a material the hardness of which is increased, so that they are not worn away even when they are subjected to the stirring and conveying force in the developing unit over a long period of time.

In this connection, the diameter of the balls 50 is approximately 4 to 8 mm and the mass is approximately 2.5 to 20 g, and the balls 50 are made of stainless steel and subjected to surface treatment. The balls 50 are put into the developer accommodating container 30 together with the two-component developer T in the manufacturing process of the developing unit.

Figure 6A:
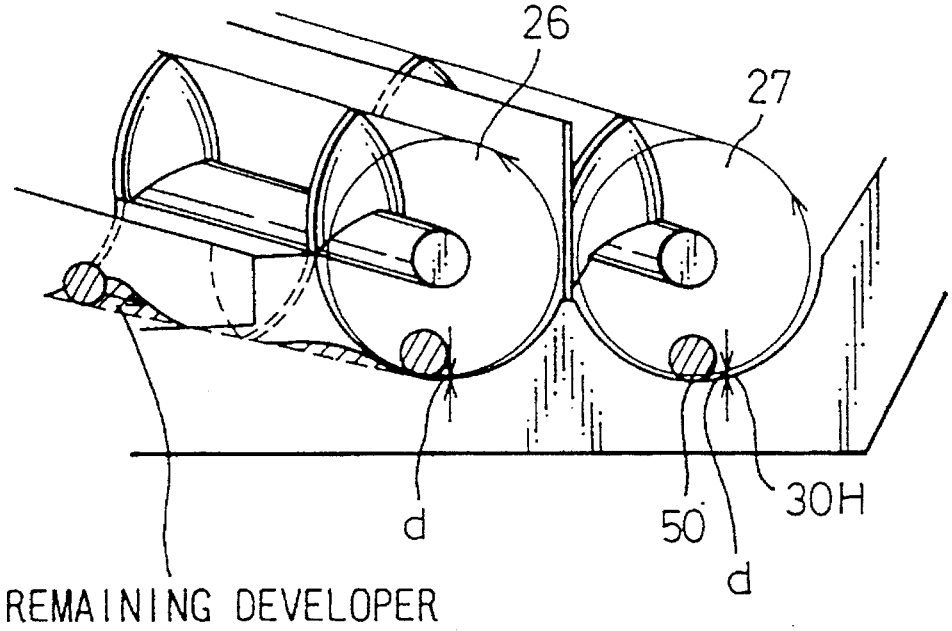
Figure 6B:
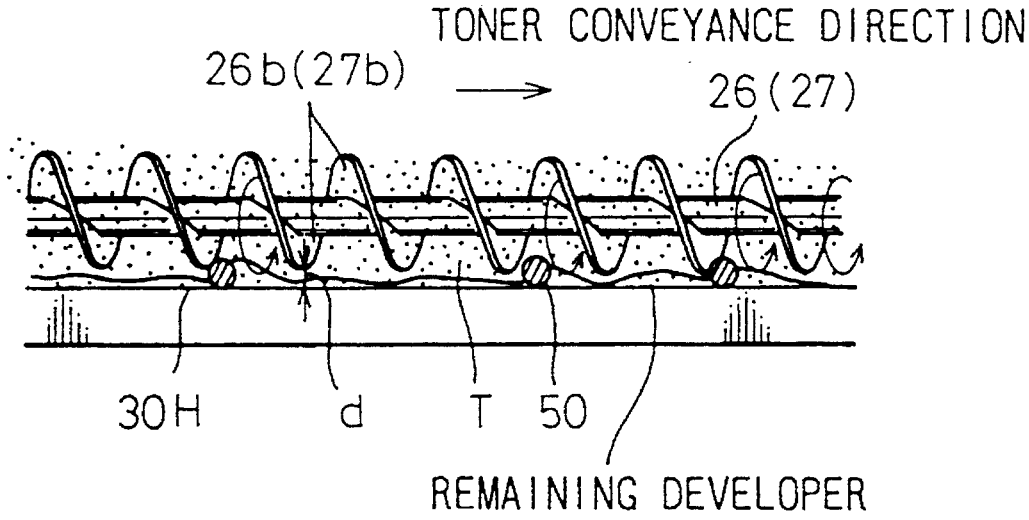

FIGS. 6(A) and 6(B) are schematic illustrations for explaining the effect of the present invention. FIG. 6(A) is a perspective view, and FIG. 6(B) is a longitudinal (i.e., side elevational) view. Numeral 50 is a ball conveyed together with the developer T. The diameter of the ball 50 is larger (the diameter is approximately 4 to 8 mm) than the gap d (the gap is approximately 0.5 mm in this case) formed between the outer diameter portions (impellers) 26*b*, 27*b* of the screws 26, 27 and the bottom surface portion 30H of the developer accommodating container 30 located just below the outer diameter portions 26*b*, 27*b*.

That is, since the diameter of the balls 50 is larger than the gap d, the balls 50 are contacted with the outer diameter portions (impellers) 26*b*, 27*b* of the screws 26, 27 so as to receive the conveyance force from the screws 26, 27 while the balls 50 are coming into contact with the bottom plate 30H. Consequently, the balls 50 push and scrape the developer T remaining in the gap d so that the developer T can be moved to a position (i.e., as defined by the outer diameter portions defined by the impellers 26*b*, 27*b* of the screws) where the stirring and conveying force of the screws 26, 27 is applied.

It is preferable that the balls 50 are made of hard and heavy material so that they do not bounce up when they come into contact with the outer diameter portions (impellers) 26*b*, 27*b*, and so that they go down into the developer T by their own weight and roll while they are coming into contact with the bottom surface potion 30H of the developer accommodating container 30. In this way, the balls 50 apply a strong conveying force (pushing force) to the developer remaining in the gap.

Accordingly, in this embodiment, several to several tens of the balls 50, made of non-magnetic stainless steel (the diameter is approximately 4 to 8 mm, and the mass is approximately 2.5 to 20 g) were used, because the balls made of non-magnetic stainless steel are appropriately heavy and hard, and further they are not attracted by the magnetic poles of the developing roller and they do not attract magnetic carrier particles. It is necessary to determine the number of balls 50 in accordance with the size of the developing unit and the stirring and conveying properties of the balls 50. In the case where the number of the balls 50 is too large, there is a possibility that the developer accommodating capacity of the developing unit is lowered. In the case where the number of the balls 50 is too small, appropriate stirring and conveying effect cannot be provided.

In this embodiment, in order to avoid influence over the triboelectric charging of developer T, the balls 50 were composed in such a manner that the cores made of stainless steel were subjected to surface treatment so as to coat the surface of the ball with the same material as that of toner and carrier, for example, acrylic resin (the film thickness was approximately 0.05 mm). The balls 50 may be discharged from the discharging port 43 together with the used developer T, the life of which has expired. However, the surface strength of the balls 50 may be improved by forming a thick resin layer on the surface of the ball 50, so that the balls 50 can be used until the life of the developing and image forming apparatus expires.

As another example, the balls 50 may be made of non-magnetic material, such as glass and resin, which provide the same effect and are heavy and hard and, further, they are not attracted by the magnetic poles of the developing roller and do not attract magnetic carrier particles.

Figure 7A:
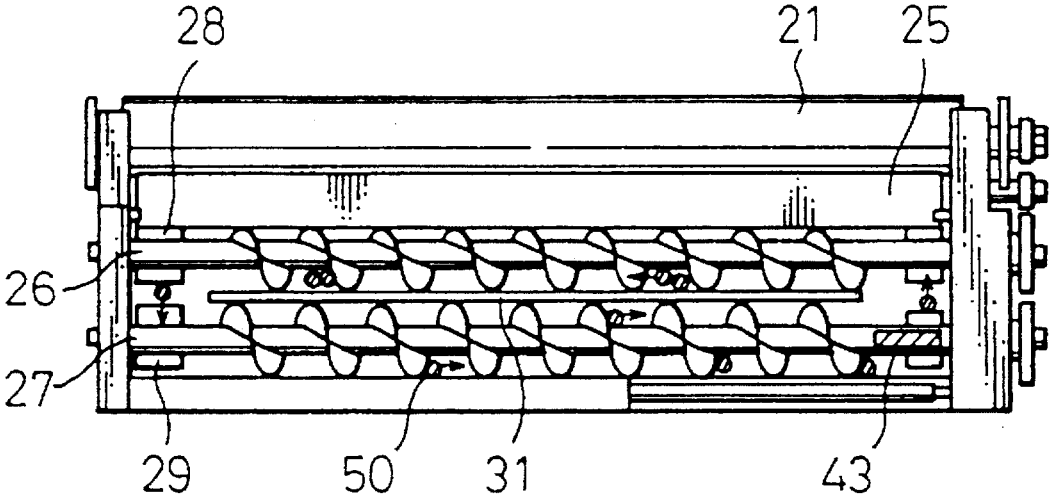
FIGS. 7(A), 7(B) and 7(C) are schematic illustrations for explaining the configuration of the discharging port.
Figure 7B:
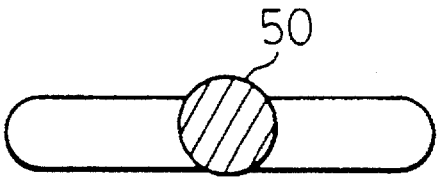
Figure 7C:
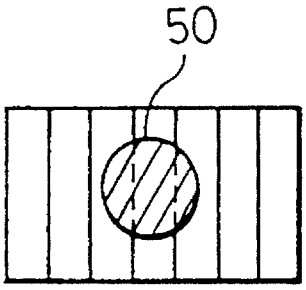

FIGS. 7(A), 7(B) and 7(C) are schematic illustrations for explaining the developer discharging port of the developing unit. FIG. 7(A) shows a position where the discharging port 43 is located, and FIGS. 7(B) and 7(C) show examples of the configuration of the discharging port 43. The discharging port 43 is arranged in the bottom surface portion 30H of the developer accommodating container 30, over an area extending from an end portion of the screw 27 to the paddle 29. The configuration of the discharging port 43 may be a long circle (i.e., a slot with opposite semicircular ends) as illustrated in FIG. 7(B), the width of which is smaller than the diameter of the ball 50; alternatively, the configuration of the discharging port 43 may be a larger rectangle with meshes defining openings, as illustrated in FIG. 7(C), the size of which openings is smaller than the diameter of the ball 50.

As described above, the size of the discharging port 43 is determined in such a manner that only the used developer T, the life of which has expired, is discharged from the discharging port 43, but the balls 50 are left in the developing unit 50. Accordingly, it is not necessary to replace the balls 50 since they are not discharged. Therefore, the balls 50 can be handled as parts of the developing unit 20 and image forming apparatus so that they can be used until the life of the developing 20 and image forming apparatus expires.

Figure 8A:
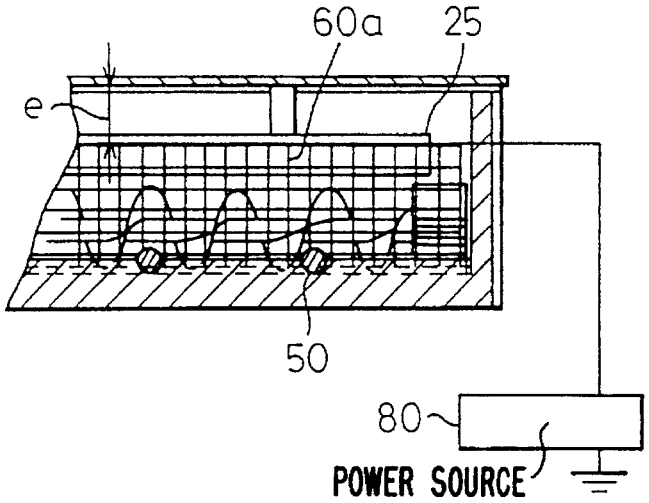
FIGS. 8(A), 8(B) and 8(C) are schematic illustrations for explaining the configuration of the regulating port.
Figure 8B:
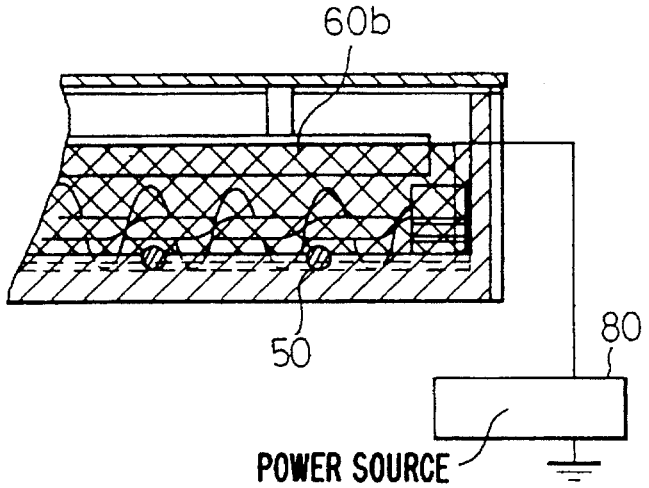
Figure 8C:
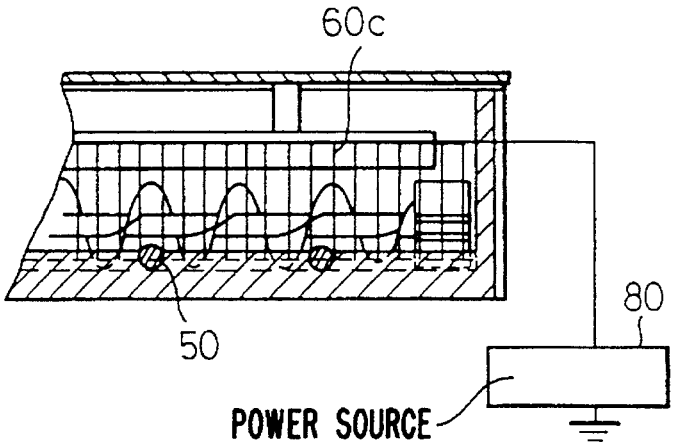

FIGS. 8(A), 8(B) and 8(C) are schematic illustrations to explain the configuration of a regulating means (i.e., unit) for regulating the movement of the balls. A regulating means 60 (60*a*, 60*b*, 60*c*) is provided between the screw 26 and the developing roller 21. By this regulating means, the balls 50 are prevented from moving to the developing roller 21 side. This regulating means 60 is composed of a metallic regulating net, the mesh size of which is smaller than the diameter of the balls 50, so that the developer T can be moved through the net, whereas, the balls 50 cannot pass through the net.

The regulating net 60 is secured to the metallic recovery blade 25, and a portion of the regulating net 60 is embedded in the bottom portion 30H of the developer accommodating container 30. Therefore, the bias voltage (−400 V) impressed upon the metallic recovery blade 25 by a constant voltage power source 80 flows into the regulating net 60. That is, the electric potential in the developing unit is maintained constant so that the developing bias voltage impressed upon the developing roller 21 cannot leak to the regulating net 60. Consequently, in the case where the regulating net 60 is made of resin, it is not necessary to impress the bias voltage upon the net.

Various configurations such as a grid or rattice can be applied to the regulating net 60. In FIGS. 8(A), 8(B) and 8(C), three different examples are shown and respectively identified by numerals 60*a*, 60*b* and 60*c*. In this connection, the regulating net 60 (60*a*, 60*b*, 60*c* ) may be integrally molded from resin together with the recovery blade 25.

In FIGS. 8(A), 8(B) and 8(C), the regulating net 60 (60*a*, 60*b*, 60*c*) is attached to the recovery blade 25. Therefore, a space "e" formed between the recovery blade 25 and the developer accommodating container 30 is not regulated by the regulating net 60. The reason is described as follows. The space "e" of the developing unit 20 of this embodiment is gradually reduced as it goes toward the outside of the developing unit. Accordingly, the balls 50 go to neither the developing roller 21 side nor the outside of the developing unit 20.

However, when the apparatus is transported or replaced, in the case where the space "e" is larger than the balls 50, there is a possibility that the balls 50 are caught in the space "e", or the balls 50 jump out to the developing roller 21 side or the outside of the developing unit 20. In order to solve the above problems, the regulating net 60 may be extended to and embedded in an upper wall portion of the developer accommodating container 30.

As described above, when the regulating net is provided, the following problems can be solved. Absent the regulating net, balls 50 are moved to the developing roller 21 side when the apparatus is transported, and the surface of the developing roller 21 is damaged so that the developer conveyance properties of the developing roller 21 are deteriorated. Likewise, absent the regulating net, balls 50 jump out of the developer accommodating container 30, and dust is scattered, so that the image forming operation is affected.

Figure 9:
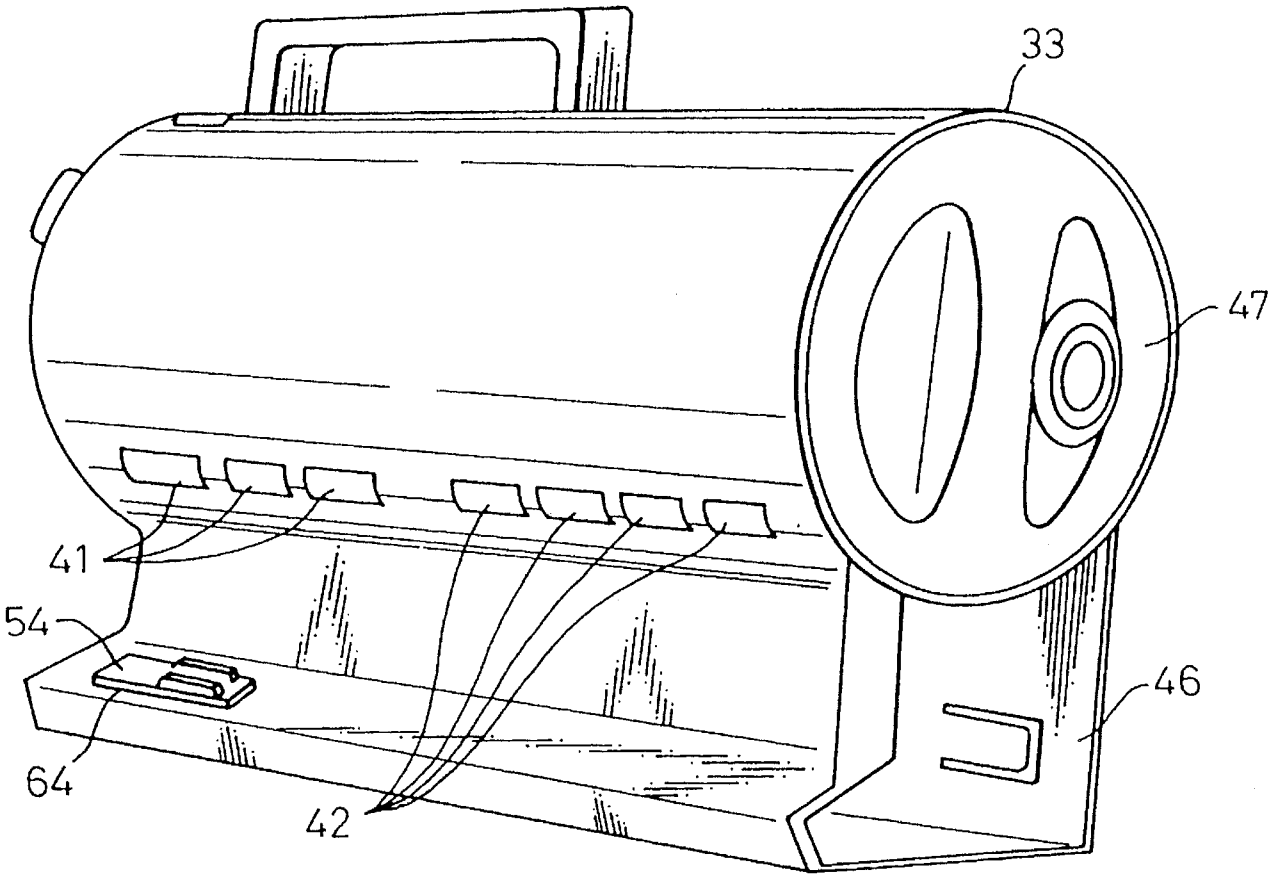
FIG. 9 is a perspective view of the cartridge.
Figure 10A:
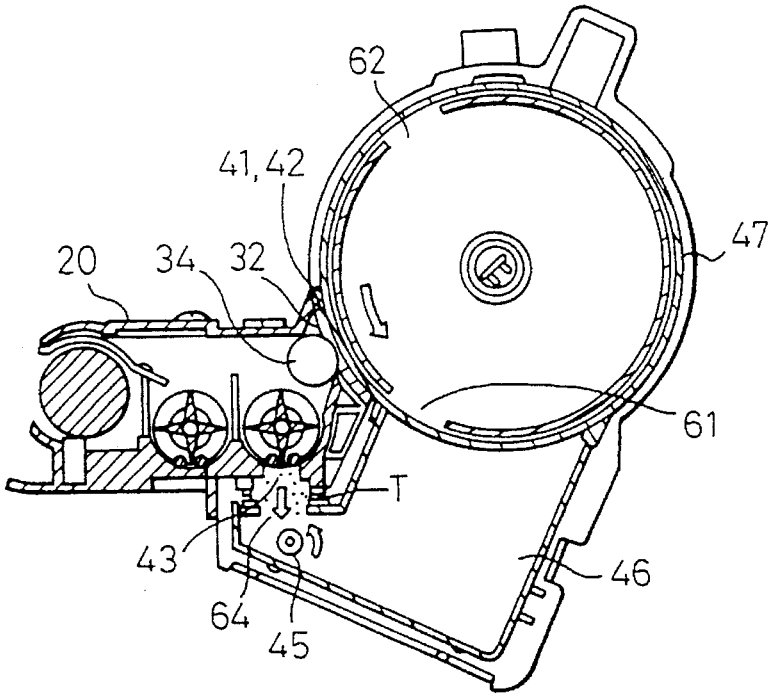
Figure 10B:
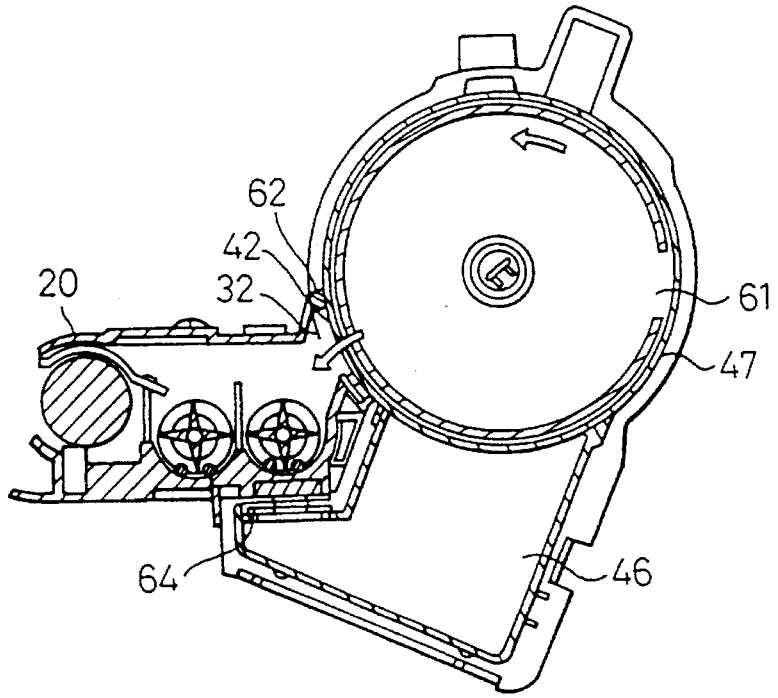

Next, the cartridge 33 will be described. The technique disclosed in Japanese Patent Application No. 04-173131 is applied to the cartridge 33 used for this embodiment, and the detailed explanations of the construction and drive will be omitted here. FIG. 9 is a perspective view of the outer appearance of the cartridge. FIG. 10(A) shows the circumstances of developer recovery in the case of replacement, and FIG. 10(B) shows the circumstances of developer supply.

The cartridge 33 includes a drum-shaped inner drum 47, and a used developer accommodating section 46. The inner drum 47 is divided into right and left sections by a partition wall. In this case, one section is a new developer accommodating section, and the other section is a toner accommodating section, and toner and carrier are respectively accommodated in each section.

Numeral 61 is a toner supply port through which toner is discharged from the toner accommodating section. Numeral 63 is an agitator for discharging the two-component developer T composed of toner and carrier into the developing unit 20.

On the other hand, the used developer accommodating section 46 includes a recovery 64 port to recover the used developer T of which the life has expired, a recover shutter 54 to cover the recovery port, and a discharging screw 45 to guide the used developer T to the accommodating section 46. In this connection, the recovery shutter 54 is constructed in such a manner that the recovery shutter 54 is opened through a hinge mounted on the developing unit 20 when the cartridge is attached, and closed when the cartridge is detached.

When a command to replace the cartridge 33 is transmitted, as illustrated in FIG. 10(A), the discharging shutter 44 of the developing unit 20 is opened, and the used developer T drops into the used developer accommodating section 46 of the cartridge 33 through the recovery port 64, and then the used developer T is discharged into the used developer accommodating section 46 by the discharging screw 45. In this way, the used developer T is recovered.

The drive means drives the developing unit 20 including the developing roller 21 ,and the screws 26, 27 for 30 minutes, so that the used developer T in the developing unit 20 is recovered. After that, the drive means closes the discharging shutter 44, and stops the discharging screw 45 so that the drive of the developing unit 20 is stopped.

At this time, together with the screws 26, 27, the balls 50 push out and sweep the used developer T, the life of which has expired, to the discharging port 43. Therefore, it is possible to shorten the drive time for discharging. In this connection, the developer discharging effect provided by the balls 50 will be explained later.

Next, the supply of developer will be explained. As illustrated in FIG. 10(B), when the new developer supplying port 61 of the inner drum 47 is opposed to the new developer charging port 41 and the receiving port 32 of the developing unit 20, the agitator 63 is rotated by the drive means. In this way, carrier in the new developer accommodating section in the inner drum 47 is charged into the developing unit 20.

After that, when the inner drum 47 is rotated, the toner supplying port 62 is opposed to the toner charging port 42 and the receiving port 32 of the developer 20. When the toner supplying roller 34 is rotated in accordance with the control of toner concentration and the agitator 63 is rotated at the same time, toner is supplied from the toner accommodating section in the inner drum 47 to the supplying roller 34, so that the toner can be supplied into the developer accommodating container 30.

Figure 11A:
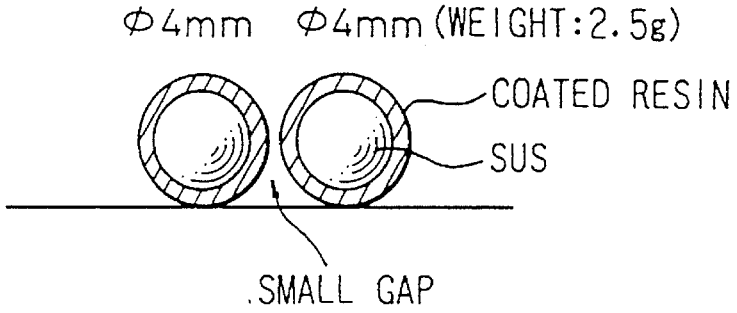
FIGS. 11(A), 11(B) and 11(C) are views showing the combination of balls, the diameter being only 4 mm, the diameter being only 8 mm, and the combination thereof, respectively.
Figure 11B:
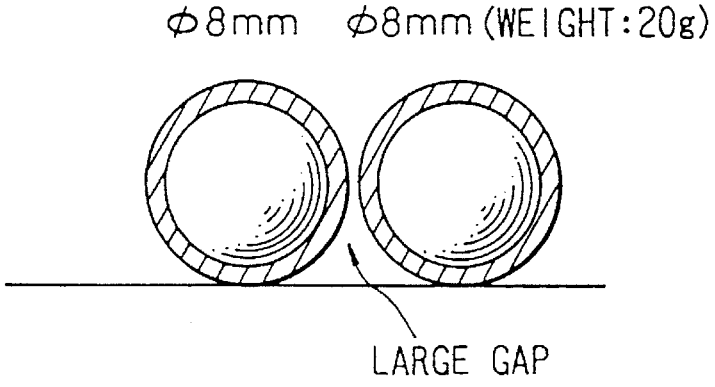
Figure 11C:
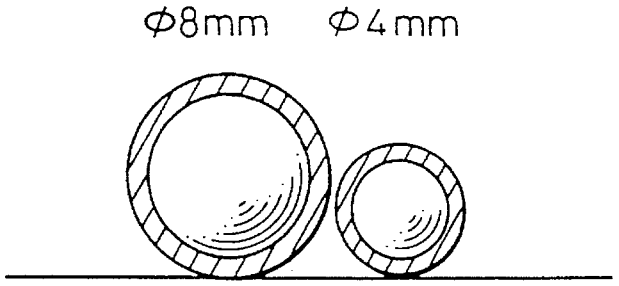

With reference to FIGS. 11(A), 11(B), 11(C) and 12, the developer discharging effect provided by the balls 50 will be explained as follows. FIGS. 11(A), 11(B) and 11(C) are views showing combinations of the balls 50. FIG. 12 is a table for explaining the developer discharging effect provided by the balls 50 combined in the above manner. In this embodiment, a developing unit 20 was used, in which developer of 700 g was accommodated, and the discharging operation for discharging used developer was conducted for 30 seconds.

Metallic balls made of stainless steel, the surface of which was subjected to surface treatment, were used, wherein the metallic balls had different size and weight, that is, the diameter was approximately $\phi$4 to 8 mm, and the mass was approximately 2.5 to 20 g, and each of ten balls 50 was respectively put by a pitch (an interval between impellers). Under the above conditions, an experiment was carried out. As a result of the experiment, an amount of residual developer was calculated, as shown in FIG. 12.

When the developing unit 20 is driven, the balls 50 are gradually collected by the action of the screws 26, 27, that is, two or three balls 50 are collected and moved in the same pitch, so that the used developer T remaining on the bottom plate 30H of the developer accommodating container 30 is pushed out by the balls, and the residual developer T remaining in the end portions of the screws 26, 27 is pushed out by the paddles 28, 29. In this way, the developer is circulated and conveyed.

When the above operation is repeated, the used developer T is conveyed to the discharging port 43 and dropped into the used developer accommodating section of the used developer accommodating container 46 from the discharging port 43. The dropped used developer T is conveyed into the used developer accommodating section by the discharging screw 45 provided in the used developer accommodating container 46.

The result of a comparison, in which the balls 50 of different sizes were used, will be described as follows. In the case where the ball size is ϕ4 mm (weight is 2.5 g), a gap formed between the balls 50 and the bottom portion 30H is small as illustrated in FIG. 11(A). Accordingly, the developer T is easily discharged.

However, the weight of the balls 50 is small, so that the pushing force given to the developer T is weak, and the amount of conveyed developer T is small. Further, the balls 50 tend to go up on the remaining developer, and it is difficult for the balls 50 to go down into the developer and to come into contact with the bottom plate 30H. Accordingly, the stirring and conveying efficiency is low.

Consequently, it was found that, as compared with a case of the conventional apparatus in which no balls 50 are provided, an amount of residual developer was reduced by about 20 g, however, a longer time was required to improve the discharging efficiency. In the case where the ball 50 size was 8 ϕmm (weight was 20 g), the gap is large as illustrated in FIG. 11(B). Therefore, the developer leaks from the gap and a large amount of developer was left without being conveyed.

However, the balls 50 are heavy, so that the pushing force of the balls is strong. Accordingly, the balls 50 go down in the remaining developer by their own weights, so that they are contacted with the bottom portion 30H. As a result, a large amount of developer T can be conveyed, and the stirring and conveying efficiency of remaining developer is high. Consequently, it was found that an amount of residual developer was small and discharging efficiency was higher in the case where the balls of 8 ϕmm were used than the case where the balls of 4 ϕmm were used.

When balls of 4 ϕmm and balls of 8 ϕmm were combined (the numbers of 4 ϕmm and 8 ϕmm were the same; i.e., five), an amount of residual developer was approximately 30 g. Therefore, it was found that the remaining developer can be effectively discharged as compared with the aforementioned two combinations. Consequently, when large and small balls are combined, the advantages and disadvantages of the large and small balls are utilized, and the stirring and conveying efficiency and discharging efficiency can be improved, so that the developer discharging drive time can be reduced.

As described above, the developing unit of this embodiment can effectively discharge the used developer of which the life has expired. Therefore, new developer is not mixed with used developer, and the quality of developer can be stabilized, and images of high quality can be developed without the occurrence of uneven density.

In the image forming apparatus of the present invention, triboelectrical charging can be conducted on developer in a good condition, and a toner image of high quality can be formed on the photoreceptor drum 10. Accordingly, an image of high quality can be formed on a recording medium.

In this embodiment, a spiral type screw is used for the developer conveying means. However, it is possible to apply the present invention to a rotational construction such as a conveyance roller, and the torque of the conveyance roller is given to the balls so that the developer remaining in a gap formed between the roller and the bottom portion of the developer accommodating container can be scraped so as to deposit it onto the conveyance roller.

The present invention can also be applied to another developing apparatus provided with screws which can circulate and convey the balls, in the manner as the developing apparatus of this embodiment in which two screws are disposed in parallel.

In the above embodiment, the developing apparatus using two-component developer is described; however, the present invention is not limited to the specific embodiment. It is possible to apply the present invention to a developing apparatus in which a one-component developer is used. In this case, the one-component developing apparatus includes a developing roller for developing an electrostatic latent image formed on a photoreceptor drum using one-component developer, a developer accommodating container for accommodating one-component developer, and an agitator for supplying the developer in the developer accommodating container to the developing roller, wherein balls having a diameter which is larger than a gap formed between the agitator and the bottom portion of the developer accommodating container are put into the developer accommodating container together with the one-component developer. Due to the foregoing, the one-component developer remaining on the bottom of the developer accommodating container can be scraped from the bottom, even if it is difficult to scrape the developer only by the agitator. Accordingly, it becomes possible to effectively utilize the one-component developer.

According to the developing apparatus of the present invention, it is possible to improve the stirring and conveying properties of a developer when the balls are stirred and conveyed together with the developer. According to the developing apparatus of the present invention, when the balls are stirred and conveyed, the developer can be triboelectrically charged in a good condition. Therefore, the developer can be stabilized, and it becomes possible to stably form an image on a latent image carrier even after the developer has been used over a long period of time.

Further, in the developing apparatus of the present invention, when the balls are stirred and conveyed together with the developer, the developer can be prevented from remaining on the bottom of the developer accommodating container. Accordingly, in a small apparatus in which a small amount of developer can be accommodated, a limited amount of developer can be effectively utilized. Further, in the developing apparatus of the present invention, when the developer is prevented from remaining on the bottom of the developer accommodating container, the life of two-component developer can be extended.

Further, in the developing apparatus of the present invention, it is possible to improve the discharging efficiency of used developer, the life of which has expired. Accordingly, it is possible to prevent the used developer from being mixed with the new developer, so that the deterioration of developer quality can be prevented.

Further, in the developing apparatus of the present invention, the surfaces of balls are coated with material which is the same as that of which the developer is composed. Therefore, even when the balls are put into the developer accommodating container, the triboelectric charging properties of developer are not affected by the balls. Further, in the developing apparatus of the present invention, even when the balls are put into the developer accommodating container, the balls are not moved onto the development carrier side since the balls are regulated by the regulating net. Accordingly, it is possible to prevent the deterioration of the conveyance properties of the development carrier, so that the image forming operation is not affected.

Further, in the developing apparatus of the present invention, since the developer discharging port is formed into a configuration by which the ball discharge can be regulated, it is not necessary to replace the balls, and the balls can be treated as component parts of the apparatus. Therefore, the balls can be used until the life of the apparatus expires.

Further, in the developing apparatus of the present invention, a developer of stable quality can be used for development. Therefore, an image of high quality without uneven density and whitening can be formed on a recording medium.

I claim:

1. A developing apparatus comprising:

a container which accommodates a developer therein;

stirring and conveying means disposed in the container for stirring and conveying the developer accommodated in the container, the container having a bottom support surface and the stirring and conveying means having an outer diameter portion which is spaced from the bottom support surface by a gap;

plural balls, each ball having a diameter larger than the dimension of the gap, received and accommodated, together with the developer, in the container and stirred together with the developer by the stirring and conveying means; and developer discharging means, having a discharging port, for discharging the developer out of said container through said discharging port, said developer discharging port having a size and configuration which prevents said balls from being discharged from said container through said developer discharging port.

2. A developing apparatus as set forth in claim 1, further comprising:

a developer carrier for carrying the developer, stirred by and conveyed thereto by said stirring and conveying means, to a latent image carrier; and regulating means, provided between said stirring and conveying means and said developer carrier, for preventing said balls from being moved to said developer carrier.

3. A developing apparatus as set forth in claim 1, wherein said developer discharging means further comprises regulating means for preventing said balls from being discharged from said container through said developer discharging port.

4. A developing apparatus as set forth in claim 3, wherein said regulating means further comprises a mesh having openings therein, each opening being of a size which is smaller than the maximum diameter of said balls, for preventing said balls from passing through the openings of said mesh.

5. A developing apparatus, comprising:

a container which accommodates a developer therein;

stirring and conveying means disposed in the container for stirring and conveying the developer accommodated in the container, the container having a bottom support surface and the stirring and conveying means having an outer diameter portion which is spaced from the bottom support surface by a gap;

plural balls, each ball having a diameter larger than the dimension of the gap, received and accommodated, together with the developer, in the container and stirred together with the developer by the stirring and conveying means; and developer discharging means, having a discharging port, for discharging the developer out of said container through said discharging port, said balls being made of a non-metallic material.

6. A developing apparatus, comprising:

a container which accommodates a developer therein;

stirring and conveying means disposed in the container for stirring and conveying the developer accommodated in the container, the container having a bottom support surface and the stirring and conveying means having an outer diameter portion which is spaced from the bottom support surface by a gap;

plural balls, each ball having a diameter larger than the dimension of the gap, received and accommodated, together with the developer, in the container and stirred together with the developer by the stirring and conveying means; and developer discharging means, having a discharging port, for discharging the developer out of said container through said discharging port, each of said balls having a surface layer which is made of a material which is the same as a material comprising the developer.

7. A developing apparatus comprising:

a container which accommodates a developer therein;

stirring and conveying means disposed in the container for stirring and conveying the developer accommodated in the container, the container having a bottom support surface and the stirring and conveying means having an outer diameter portion which is spaced from the bottom support surface by a gap;

plural balls, of respective, different diameters, each ball having a diameter larger than the dimension of the gap, received and accommodated, together with the developer, in the container and stirred together with the developer by the stirring and conveying means; and developer discharging means, having a discharging port, for discharging the developer out of said container through said discharging port.

8. A developing apparatus comprising:

a container which accommodates a developer therein;

stirring and conveying means disposed in the container for stirring and conveying the developer accommodated in the container, the container having a bottom support surface and the stirring and conveying means having an outer diameter portion which is spaced from the bottom support surface by a gap;

plural balls, each ball having a diameter larger than the dimension of the gap, received and accommodated, together with the developer, in the container and stirred together with the developer by the stirring and conveying means; and a screw rotatably disposed in said container and a discharging port, said screw having a thread thereon with a pitch larger than the maximum diameter of said balls and being rotatable for conveying the developer accommodated in said container to, and discharging the conveyed developer through, said discharging port and so that said balls can be stirred with the developer by said screw.

9. A developing apparatus as set forth in claim 8, wherein said developer is two-component developer.

10. An image forming apparatus comprising:

a latent image carrier on which a patent image is formed in accordance with image information;

a container Which accommodates a developer therein;

stirring and conveying means disposed in the container for stirring and conveying the developer accommodated in the container, the container having a bottom support surface and the stirring and conveying means having an outer diameter portion which is spaced from the bottom support surface by a gap;

a developer carrier for carrying the developer, conveyed thereto by said stirring and conveying means, to said latent image carrier;

a transfer unit for transferring an image on said latent image carrier to a printing sheet;

plural balls, each ball having a diameter larger than a gap formed between an outer diameter portion of said stirring and conveying means and a bottom portion of said developer accommodating container, wherein said balls are stirred and conveyed by said stirring and conveying means together with the developer in said developer accommodating container; and developer discharging means, having a discharging port, for discharging the developer out of said container through the discharging port.

11. An image forming apparatus as set forth in claim 10, wherein said developer discharging means is provided with regulating means for preventing said balls from being discharged from said container through said developer discharging port.

12. An image forming apparatus as set forth in claim 11, wherein said regulating means comprises a mesh having openings therein, each opening being of a size which is smaller than the maximum diameter of said balls, for preventing said balls from passing through said meshes.

13. An image forming apparatus as set forth in claim 10 further comprising: a regulating means, provided between said stirring and conveying means and said developer carrier, for preventing said balls from being moved to said developer carrier.

14. An image forming apparatus as set forth in claim 13, wherein said regulating means comprises a net having a lattice or a grid configuration.

* * * * *

UNITED STATES PATENT AND TRADEMARK OFFICE

CERTIFICATE OF CORRECTION

PATENT NO. : 5,581,337

DATED : December 3, 1996

INVENTOR(S) : Eiji Suzuki

It is certified that error appears in the above-indentified patent and that said Letters Patent is hereby corrected as shown below:

On title page, item [56] "U.S. Patent Documents" should read as follows:

--4,565,435 1/1986 Hart.....355/220--

--5,243,390 9/1993 Takemoto et al.....355/245--

--5,384,629 1/1995 Watanabe et al. .....355/260--

UNITED STATES PATENT AND TRADEMARK OFFICE

CERTIFICATE OF CORRECTION

PATENT NO. : 5,581,337
DATED : Dec. 3, 1996
INVENTOR(S) : SUZUKI

It is certified that error appears in the above-indentified patent and that said Letters Patent is hereby corrected as shown below:

Col. 1, line 41, after "screws" (second occurrence) insert --,--;
line 42, delete "and".

Col. 4, line 19, after "ball 5" insert --, having a--;
line 50, change "8;" to --8--;
line 51, change "device)." to --device)--.

Col. 5, line 22, after "instead" insert --,--;
line 36, change "be" to --are--;
line 38, change "prevented, and further" to --prevented; further,--;
line 48, change "of," to --of a common--.

Col. 6, line 35, after "sheet and" insert --thereby is--.

Col. 9, line 46, change "potion" to --portion--.

Col. 10, line 38, after "parts" insert --(i.e., components)--.

Col. 11, line 54, change "64 port" to --port 64--.

Col. 16, line 58 (Claim 10, line 4), change "Which" to --which--.

Signed and Sealed this
Tenth Day of June, 1997

Bruce Lehman

*Attest:*

BRUCE LEHMAN

*Attesting Officer*

*Commissioner of Patents and Trademarks*